US005300745A

United States Patent [19]

Chartrain et al.

[11] Patent Number: 5,300,745

[45] Date of Patent: Apr. 5, 1994

[54] APPARATUS FOR PLACING A MICROWAVE OVEN IN A STANDBY CONDITION

[75] Inventors: Pierre Chartrain, Soliers Bourguebus; Michel G. de Matteis, Cambes-en-Plaine; Bernard M. Bois, Caen, all of France

[73] Assignee: Moulinex (Societe Anonyme), Bagnolet, France

[21] Appl. No.: 825,120

[22] Filed: Jan. 24, 1992

[30] Foreign Application Priority Data

Jan. 25, 1991 [FR] France ..... 91 00846

[51] Int. Cl.[5] ..... H05B 6/76

[52] U.S. Cl. ..... 219/722; 219/739; 292/DIG. 69; 292/106; 292/113; 126/197; 200/50 A; 200/50 C; 200/61.62

[58] Field of Search ..... 219/10.55 C, 10.55 D; 292/DIG. 69, 106, 113; 126/197; 200/50 A, 50 C, 61.62, 61.76

[56] References Cited

U.S. PATENT DOCUMENTS

| | | | |
|---|---|---|---|
| 3,496,316 | 2/1970 | Foerstner | 219/10.55 C |
| 4,341,409 | 7/1982 | Sakoda | 292/254 |
| 4,450,335 | 5/1984 | Shimizu et al. | 219/10.55 C |
| 4,497,513 | 2/1985 | Sasaki | 292/217 |
| 4,509,779 | 4/1985 | Sasaki | 292/254 |
| 4,745,250 | 5/1988 | Mayo | 219/10.55 C |
| 4,749,835 | 6/1988 | Fukumoto | 219/10.55 C |
| 4,755,647 | 7/1988 | Nishikawa et al. | 219/10.55 C |
| 4,825,027 | 4/1989 | Yoon | 219/10.55 C |
| 4,982,063 | 1/1991 | Tsunekawa et al. | 219/10.55 C |

FOREIGN PATENT DOCUMENTS

| | | |
|---|---|---|
| 0342307 | 11/1989 | European Pat. Off. . |
| 3722758 | 10/1988 | Fed. Rep. of Germany . |
| 2176658 | 12/1986 | United Kingdom . |

*Primary Examiner*—Bruce A. Reynolds
*Assistant Examiner*—Tu Hoang
*Attorney, Agent, or Firm*—Young & Thompson

[57] ABSTRACT

An oven comprises a cooking chamber having a movable door (3) hinged on the forward surface (2) of said oven and provided with a hook (4) comprising a nose (5) and a catch (6). The hook enters an opening (9) in the forward surface to actuate a movable locking element (7). The locking element comprises a wheel (20) pivotally mounted on a plate (14) fixed to the forward inside surface of the oven. This wheel comprises a first surface (A) comprising two abutment lugs (22 and 23), a safety lock constituted by a blocking finger (25) fixed on the second surface (B) of the wheel and controlled by a safety spur (24) that projects through an opening (23') transversely to the first surface (A) and adapted, either to come into abutment with stop boss (26) of the plate, or to permit the rotation of the wheel. Application to all closure devices, particularly to a household microwave oven to prevent operation thereof by e.g. a child, when the door is open.

9 Claims, 4 Drawing Sheets

FIG_3-a
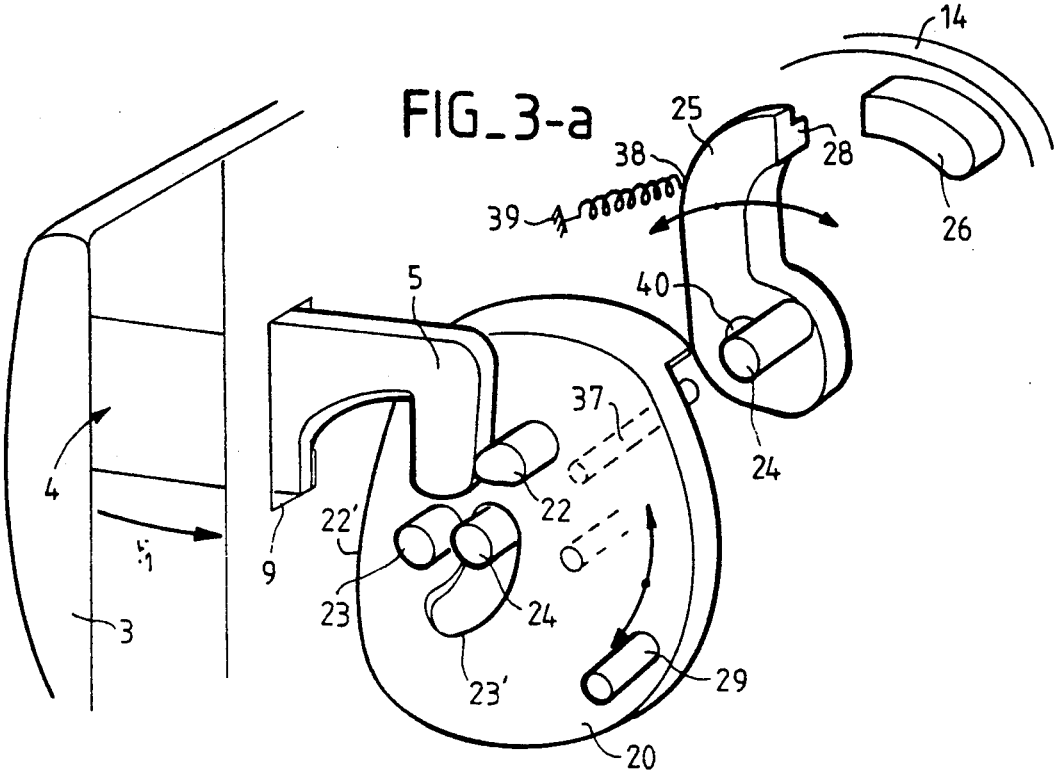
FIG_3-b
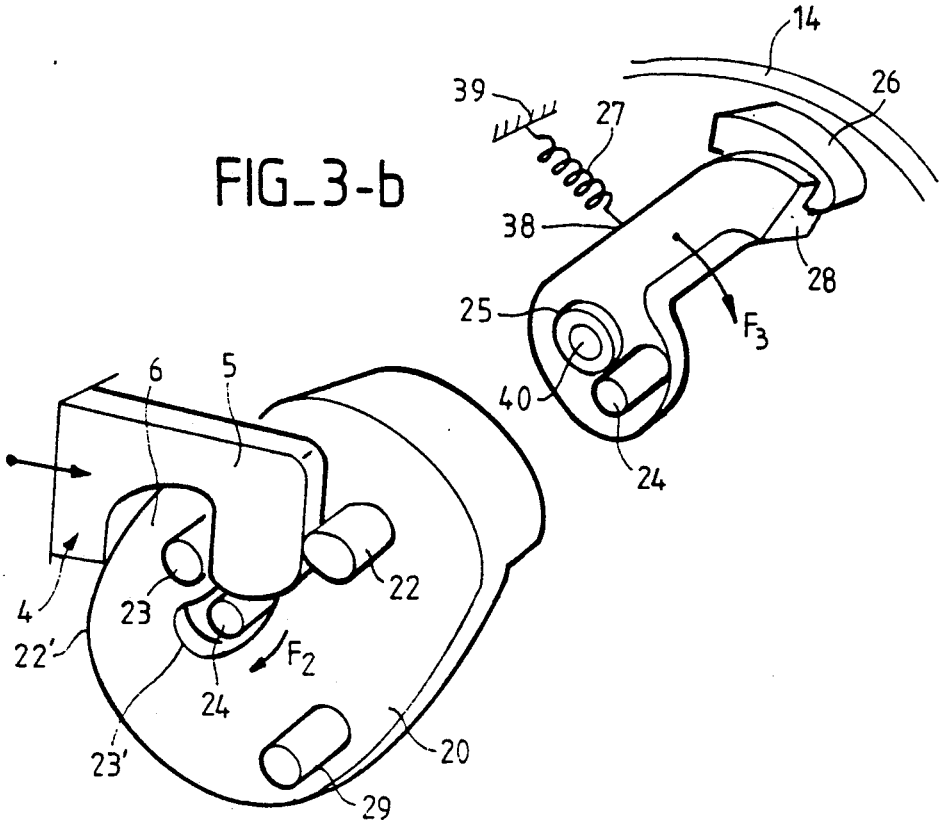

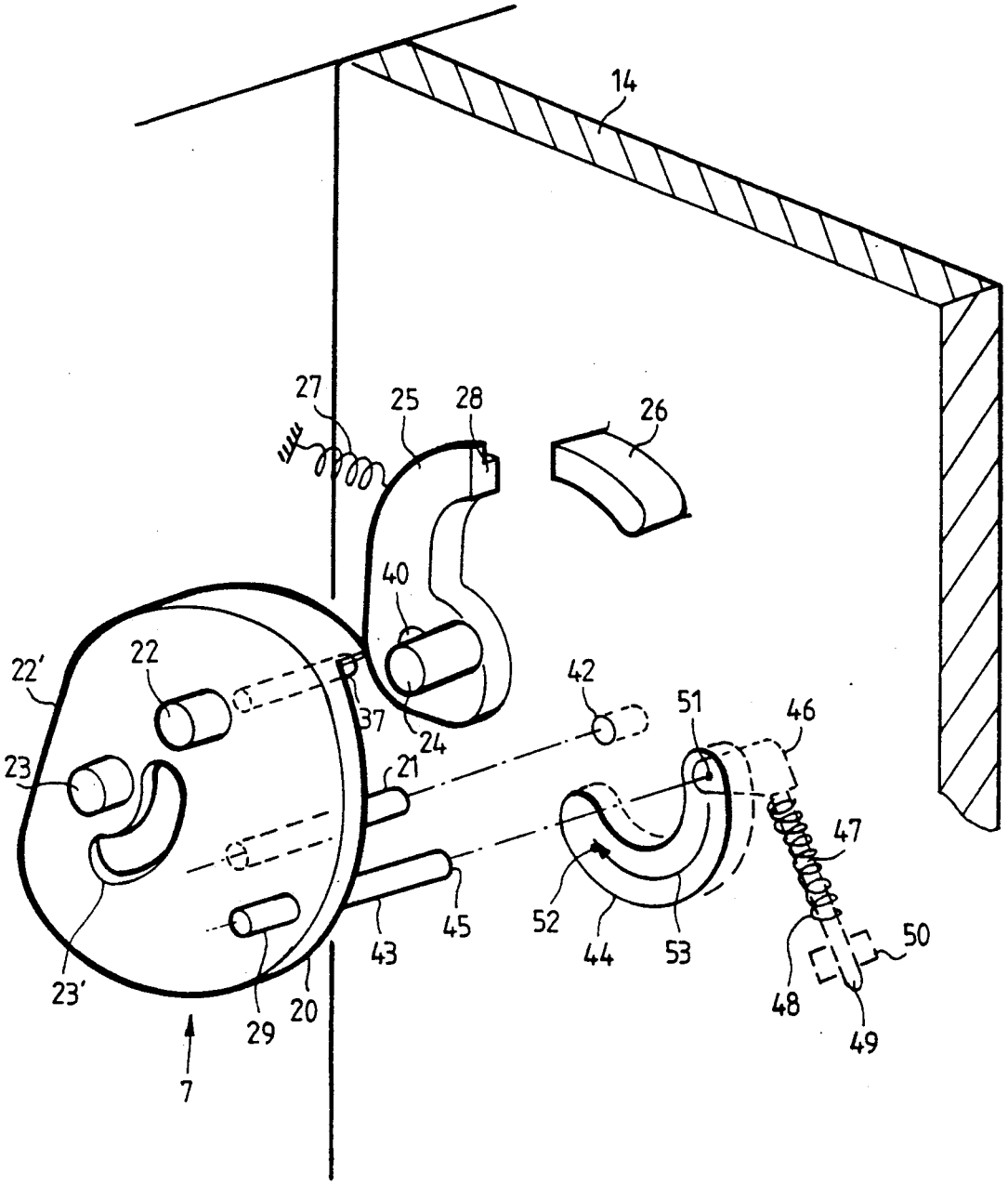
FIG_3-c

APPARATUS FOR PLACING A MICROWAVE OVEN IN A STANDBY CONDITION

FIELD OF THE INVENTION

Background of the Invention

The present invention relates to microwave ovens and more particularly to safety devices used in microwave ovens. Generally speaking, a microwave oven comprises a cooking chamber provided with a movable door pivoted on the forward surface of the oven and adapted to close completely the opening of the chamber by overlying the forward surface. The movable door is maintained closed at least by a hook which enters into an opening located on said forward surface and which comprises a nose for actuating a locking element as well as a catch located behind the nose and in which the locking element engages. Said locking element thus positioned permits subsequent closing of an operating switch of said oven under the influence of an operating button located on a control panel provided on the forward surface of the oven.

The openings into which the hook enters being sufficiently visible when the microwave oven door is open, it is possible for a child to introduce into this opening a flat element, for example the handle of a spoon, so as to actuate the locking element. In this position, the oven needs only pressure on the operating button to be actuated. This safety system is accordingly not sufficiently reliable and can be dangerous for children.

OBJECT OF THE INVENTION

The object of the invention is to overcome this drawback by providing a device permitting avoiding any operation when the microwave oven door is open.

SUMMARY OF THE INVENTION

According to the invention, the device is characterized in that the locking element is constituted by a wheel which is positioned on a plate fixed transversely to the forward internal surface of the microwave oven and is fixed to this plate by a shaft parallel to said forward surface and about which the wheel can rotate, said wheel comprising a first surface having two abutment lugs, a first abutment lug located in the path of the nose and a second abutment lug angularly offset and adapted after rotation of said wheel by the action of the nose on the first lug, to come into engagement with the catch of the hook as well as a security lock comprising a blocking finger which is adapted to come into abutment with an arresting boss integral with the plate and disposed facing the second surface of the wheel, and which is movably mounted for this purpose under the influence of elastic means on said second surface of the wheel, said blocking finger being controlled by a safety spur which projects through an opening traversely to the first surface of the wheel, and which is disposed between the two abutment lugs so as to occupy two positions, either a standby position in which it is actuated by the nose of the hook and in which it retracts the blocking finger thereby permitting predetermined rotation of the wheel so as to permit subsequent closing of the operating switch, or an active position in which, in the absence of action on the nose, it comes into abutment against the stop abutment and prevents the rotation of said wheel thereby prohibiting closing the switch.

Thanks to this arrangement according to the invention, there is provided a simple system for operation, and the safety of a microwave oven is substantially increased, by preventing any user from triggering the operation of the apparatus when the door of the oven is open. On the other hand, the device mounted parallel to the openings through which the hook of the lock extends, permits freeing a substantial space behind the control panel of the microwave oven and thereby limiting its size.

BRIEF DESCRIPTION OF THE DRAWINGS

The characteristics and advantages of the invention will appear further from the description which follows, by way of example, with reference to the accompanying drawings, in which:

FIGS. 3*a* and 3*b* show in exploded view the locking element of FIG. 2 shown in two different stages of operation of the device according to the invention; and FIG. 3*c* shows an exploded view of the locking element according to the invention before its mounting on a fixed plate transversely to the forward surface of the microwave oven.

DETAILED DESCRIPTION OF THE INVENTION

Figure 1:
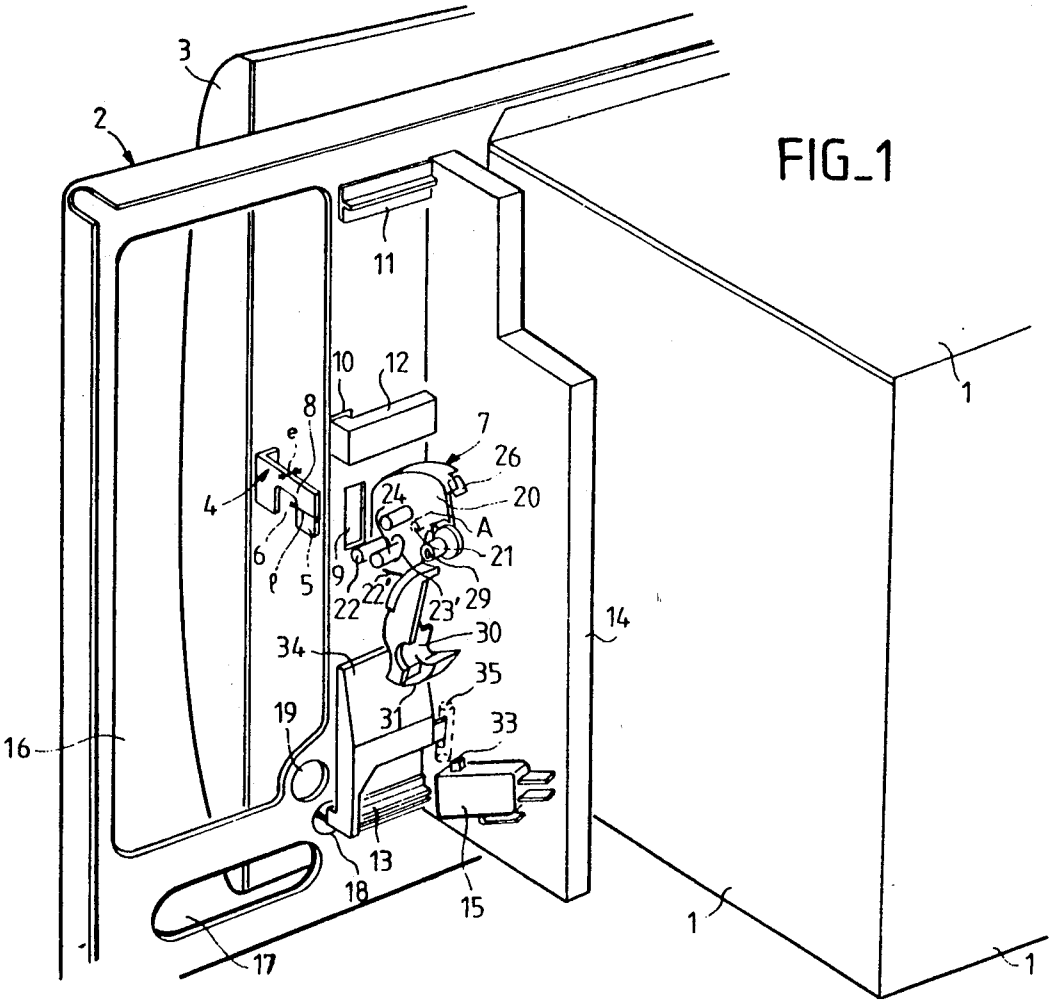
FIG. 1 shows a perspective of the standby device according to the invention, disposed in a microwave oven partially illustrated and provided with a movable door in half open position.

According to FIG. 1, only a portion of the elements constituting a microwave oven is shown. A microwave oven comprises a cooking chamber, not shown, whose side walls bear reference numeral 1. A forward surface 2 of the microwave oven comprises an opening giving access to the cooking chamber. A movable door 3 hinged on the forward surface 2 is adapted to close completely the cooking chamber. The movable door 3 comprises a closing system, for example, at least one hook 4 secured, for example, immovably on the door and permitting effecting complete closing of the door; this hook comprises, for example, an actuating nose 5 and a catch 6. The catch 6 has for example an inverted U-shape, the curved portion of the U being slightly modified so as to create a slight slope rising in the direction of the nose and facilitating the sliding of the locking element 7 of the microwave oven. The actuating nose has, for example, a thickness e the same as hook 4, a width 1 and a neck 8 sufficiently wide to avoid any flexibility of said nose during contact of the nose on the locking element 7 of the microwave oven.

The forward surface 2 of the microwave oven comprises, in addition to a first opening 9 permitting the hook 4 of the movable door 3 to penetrate so as to come into engagement with the locking element 7, other openings of which a single one 10 is shown in FIG. 1, these openings permitting, for example, by securement tongues 11, 12 and 13, the positioning of a plate 14 supporting, among other things, the locking element and an operating switch 15 for the microwave oven, plate 14 being fixed transversely to the forward surface 2 of the microwave oven between one of the side walls 1 of the cooking chamber of the microwave oven and the locations 16, 17, 18 and 19 provided for the reception of a control panel, not shown, and containing, for example, components determining the instructions as to time, power, rapid cooking with timing control, and of actuation of the apparatus.

The locking element 7 fixed on the plate 14 is constituted for example by a wheel 20. The wheel 20 is mounted rotatably on plate 14 about a shaft 21 located parallel to the forward surface 2 of the microwave oven and integral with the plate 14. Wheel 20 comprises moreover two opposite surfaces A and B of which only one A is visible in FIG. 1. The first surface A comprises, for example, two abutment lugs 22 and 23, a first abutment lug 22 located in the path of nose 5 of hook 4 of the movable door 3 and a second lug 23, located near edge 22' of the first surface A and angularly displaced relative to the first lug 22 to avoid any abutment of the nose 5 with the second lug 23 during closing of the movable door 3, as well as an arcuate slot 23' disposed angularly between and below the two abutment lugs 22 and 23 and receiving a safety spur 24 positioned transversely of the first surface A of the wheel 20 and constituting moreover a blocking finger member 25 (shown in FIGS. 3*a* to 3*c*) movably mounted on the second surface B of the wheel 20 and facing the plate 14. The blocking finger 25 is an element of a safety lock comprising moreover a stop boss 26 integral with the plate 14 and disposed facing the second surface B of the wheel 20. The blocking finger 25 is movably mounted under the action of elastic means constituted for example by a coil tension spring 27 (shown in FIGS. 3*a* to 3*c*), secured on second surface B of wheel 20 and which tends to raise the free end 28 of blocking finger 25 to a position such that when no action is exerted on safety spur 24, spur 24 will be held by spring 27 at the top end of slot 23' and boss 26 will be in the path of swinging movement of free end 28. When wheel 20 turns clockwise as seen in the drawings, so that the rotation of the wheel 20 will be limited to the distance existing between the free end 28 of blocking finger 25 and the boss 26. Said lugs 22 and 23 are for example ovoidal. The first surface A of the wheel 20 comprises also a shaft 29 located on the periphery of wheel 20 and situated at the apex of a triangle passing through the abutment lugs 22 and 23. A swinging lever 30 is freely mounted about this shaft 29 in pendulum fashion. The free end 31 of this swinging lever 30 has for example a rounded shape.

Figure 2:
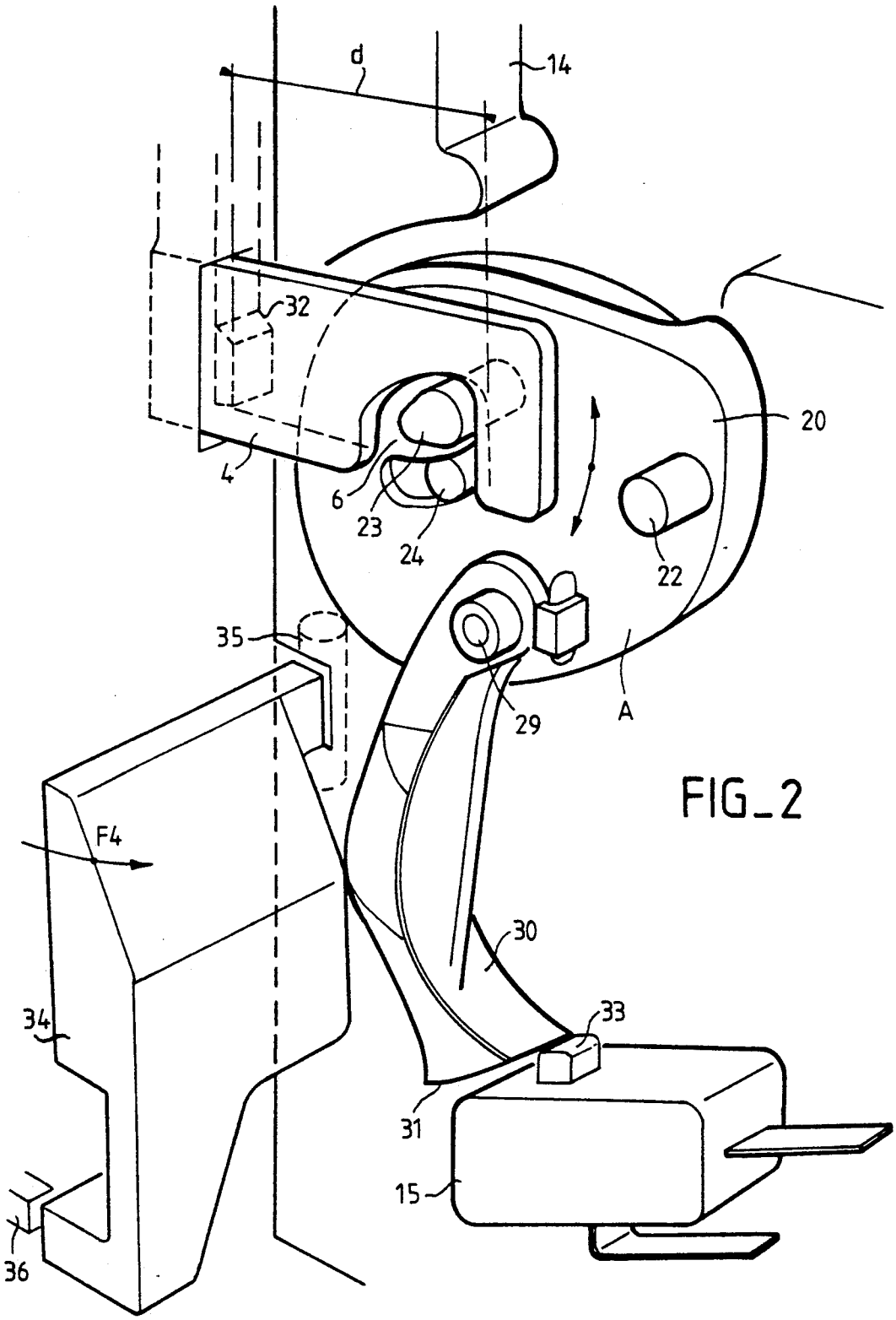
FIG. 2 shows on a greater scale and in perspective the standby positioning device of FIG. 1.

According to FIG. 2, when the oven door is closed, the second lug 23 as well as the safety spur 24 of the wheel 20 are disposed in the interior of the catch 6 of the hook 4. The wheel 20 having on its first surface A the shaft 29 on which is movably mounted the swinging lever 30, said swinging lever 30 moves from the position shown in FIG. 1 to the position shown in FIG. 2. Thus, upon rotation of the wheel 20, the shaft 29, on which is mounted in pendulum fashion the swinging lever 30, effects a movement of rotation limited by a shoulder 32 of the hook 4 (shown in broken lines). The shoulder 32 is adapted to come into abutment against the forward surface 2 of the oven when the movable door 3 completely closes the chamber, a distance d between said shoulder 32 and the inside surface of the catch 6 adjacent the nose 5 being thus defined with precision by the manufacturer to effect complete closure of the door 3 without any play.

This swinging lever 30, under the influence of gravity, at its end 31 comes into position at the level of the switch 15. This switch 15 having a starting pushbutton 33, a pivoting movement of the swinging lever 30 suffices to activate switch 15 to operate the microwave oven. This pivoting movement of swinging lever 30 is effected, for example, by a vane 34 movably mounted for rotation about a pivot axis 35. The rotation of this vane, in the direction of arrow F4, is brought about, for example, by operating button 36 which is the actuating button of the microwave oven situated on the control panel and partially illustrated.

According to FIG. 3*a*, upon closure of the movable door 3 on which is fixed the hook 4, the nose 5 of hook 4 effects a movement of rotation about the swinging axis of the door in the direction of arrow F1. Nose 5 engages in opening 9 in the forward surface 2 of the microwave oven and strikes the first lug 22 of the wheel 20. Before contact of the nose 5 with a first lug 22, the blocking finger 25, shown detached from wheel 20 for better understanding, is located adjacent boss 26 to come into contact with this latter if no force is exerted on safety spur 24. The closing of the door having taken place, as shown in FIG. 3*a*, the force F1 exerted on the first lug 22 drives the wheel 20 in rotation.

On the other hand, according to FIG. 3*b*, the nose 5 of the hook exerts by its lower portion, on the safety spur 24, an action in the direction of arrow F2. The blocking finger 25 is movably mounted on an axle 37 on the second surface B of the wheel 20, under the action of spring 27 comprising two ends 38 and 39, one 38 being connected to the blocking finger 25, the other 39 being connected to the wheel 20, this connection being schematically shown in the exploded views 3*a*, 3*b*, 3*c*.

The swinging of the safety spur 24 and the rotation of the wheel 20 permit the blocking finger 25 to pivot and retract, thereby avoiding the boss 26 which would limit the angular displacement of the wheel 20 when no force is exerted on safety spur 24.

In other words, the free end 28 of finger 25 would strike boss 26 and prevent further rotation of wheel 20 if there were no action on spur 24; but when nose 5 strikes spur 24, then finger 25 swings clockwise relative to wheel 20 about axle 37, into a forwardly inclined position shown in FIG. 3*b*, in which end 28 of finger 25 misses boss 26 and wheel 20 can execute its complete rotary movement and the door can fully close.

The final position of the wheel 20 after complete closure of the movable door 3 of the microwave oven is shown in FIG. 2.

According to FIG. 3*c*, the finger 25 has a hole 40, parallel to the safety spur 24 and which permits reception of the shaft 37 on the second surface B of the wheel 20. The wheel 20 has its mounting shaft 21 mounted rotatably in a hole 42 provided in plate 14. A lock washer (not shown) secured on the end of shaft 21 after its engagement in hole 22 on the other surface (not shown) of the plate 14 permits the axial positioning of the wheel 20 on the plate 14 while leaving the wheel 20 free to rotate about the shaft 21.

Wheel 20 is limited in its angular displacement by the hook 4 of the movable door 3 of the microwave oven. Moreover, to draw the hook 4 toward the interior of the oven, and thus to apply the door against the forward surface, the wheel 20 and thus the first lug 22 are subjected to a rotative drive device comprising a tenon 43 mounted on the second surface B of the wheel 20 and disposed in alignment with the shaft 29 on the first surface A of the wheel 20, said tenon 43 passing along a slideway 44 provided in plate 14.

To control the displacement of the tenon 43, the outwardly extending end 45 of the tenon 43, after mounting of the wheel 20 on the plate 14, is secured to a first end 46 of an over-center toggle 47 under the influence of a spring 48 and shown in broken lines because it is disposed on the other side of plate 14, while a second end 49 passes through a support 50 fixed to and integral with the plate 14 and serves as abutment for the spring 48 as well as a sliding bearing for the toggle 47.

Thus the tenon 43 of the wheel 20 passes from a first position shown at 51 showing the axis of tenon 43 when no force is exerted on the lugs 22 and 23 or on safety spur 24, to a second position shown at 52 showing the axis of tenon 43 after the exertion of force on the recited elements. An arrow 53 shown in slideway 44 describes the movement of rotation undergone by the tenon 43 of the wheel 20 when the blocking finger 25 of the wheel 20 is retracted, thereby avoiding abutment with the boss 26 and permitting the continued rotational movement of wheel 20.

Other operating buttons can actuate the rotation of the swinging lever 30 to operate the starting switch 15 of said oven, for example, the button of a preprogrammed timer of a microwave oven of the type described, for example, in French patent application No. 2 630 613 or an electronic button of a microwave oven, but in these latter cases, it is necessary to adapt the position of the appropriate mechanisms, not illustrated, to permit operation of the device. The device according to the invention is applicable to microwave ovens but could equally be applicable to other apparatus requiring very reliable safety.

What is claimed is:

1. In a device for placing in standby condition a microwave oven comprising a cooking chamber having a movable door (3) pivoted on the forward surface (2) of said oven and adapted to completely close the opening of the chamber by overlying the forward surface (2), said door (3) being maintained closed by means of a hook (4) which enters an opening (9) located on said forward surface (2) and which comprises a nose (5) for actuating a movable locking element (7), a catch (6) located behind the nose (5), and in which the locking element (7) engages and permits subsequent closing of an operating switch (15) for said oven under the action of an operating button (36) located on a control panel provided on the forward surface of the oven; the improvement wherein the locking element (7) is constituted by a wheel (20) which is located on a plate (14) fixed transversely to the inside of said forward surface (2) of the microwave oven and which is fixed to said plate (14) by a shaft (21) parallel to said forward surface (2) and about which the wheel (20) rotates, said wheel (20) comprising a first surface (A) comprising two abutment lugs (22, 23), a first abutment lug (22) located in a path of the nose (5) and a second abutment lug (23) angularly offset from the first abutment lug and adapted, after rotation of said wheel (20) under the action of the nose (5) on the first lug (22), to come into engagement in the catch (6) of the hook (4), a safety lock comprising a blocking finger (25) which is adapted to come into abutment with a stop boss (26) integral with the plate (14) and disposed facing a second surface (B) of the wheel, and which is movably mounted for this purpose under the influence of elastic means (27) secured to the wheel, said blocking finger (25) being controlled by a safety spur (24) which projects through an opening (23') transversely to the first surface (A) of the wheel (20), and which is provided angularly between and below the two abutment lugs (22, 23) to occupy two positions comprising a standby position in which it is actuated by the nose (5) of the hook (4) and in which it withdraws the blocking finger (25) thereby permitting predetermined rotation the wheel (20) to permit subsequent closing of the operating switch (15), and an active position in which, in the absence of action by the nose (5), the blocking finger (25) comes into abutment with the stop boss (26) and prevents rotation of said wheel (20) thereby preventing closure of the switch (15).

2. Device for placing a microwave oven in standby condition according to claim 1, wherein the first surface (A) of the wheel (2) comprises a shaft (29) on which his movably mounted a swinging lever (3) which, after rotation of the wheel (20) under a force from the hook (4) of the movable door (3), passes from a first rest position corresponding to the door (3) being open to a second standby position corresponding to a complete closure of the door (3) and in which it permits a subsequent closing of the switch (15).

3. Device for placing a microwave oven in standby condition according to claim 2, wherein the swinging lever (30) is pendulously mounted about the shaft (29) and is positioned by gravity in said second position, adjacent a pushbutton (33) of the operating switch (15) to close the operating switch when said swinging lever (30) is pivoted by contact with the pushbutton (33).

4. Device for placing a microwave oven in standby condition according to claim 3, wherein pivoting of the swinging lever (30) is controlled by a vane (34) freely rotatably mounted about an axle (35) secured to the plate (14) and actuated by the operating button (36) positioned on the control panel of the microwave oven.

5. Device for placing a microwave oven in standby condition according to claim 4, wherein the operating button (36) of the microwave oven is an actuating button of said microwave oven.

6. Device for placing a microwave oven in standby condition according to claim 1, wherein the second surface (B) of the wheel (20) comprises a tenon (43) received in a slideway (44) provided in the plate (14) to limit angularly rotation of the wheel (20).

7. Device for placing a microwave oven in standby condition according to claim 6, wherein the tenon (43) of the wheel (20) has an end (45) which is received in a first end (46) of a toggle (47) having over-center instability under an influence of a spring (48) to effect abrupt rotational movement of the wheel (20).

8. Device for placing a microwave oven in standby condition according to claim 1, wherein the catch (6) of the hook (4) has the shape of an inverted U whose central portion curves at a slight incline rising in a direction of the nose (5).

9. Device for placing a microwave oven in standby condition according to claim 1, wherein the hook comprises at its base a shoulder (32) adapted to come into contact against the forward surface (2) of the oven when the movable door (3) completely closes the chamber, a distance (d) between said shoulder (32) and an inside surface of the catch (6) adjacent the nose (5) being defined to obtain complete closure of the door (3).

* * * * *